US007690522B2

(12) United States Patent
Rood

(10) Patent No.: US 7,690,522 B2
(45) Date of Patent: Apr. 6, 2010

(54) EXTENDABLE CARGO SYSTEM AND METHOD THEREFORE

(76) Inventor: Charles H. Rood, 111 Countryside Dr., Youngsville, LA (US) 70592

( * ) Notice: Subject to any disclaimer, the term of this patent is extended or adjusted under 35 U.S.C. 154(b) by 270 days.

(21) Appl. No.: 11/942,625

(22) Filed: Nov. 19, 2007

(65) Prior Publication Data

US 2009/0127255 A1 May 21, 2009

(51) Int. Cl.
*B65D 88/00* (2006.01)

(52) U.S. Cl. ..... 220/1.5; 220/682

(58) Field of Classification Search ..... 220/1.5, 220/4.33, 4.34, 6, 23.4, 682, 692, 693; 206/600; 211/175; 296/26.08
See application file for complete search history.

(56) References Cited

U.S. PATENT DOCUMENTS

| | | | | |
|---|---|---|---|---|
| 2,761,581 | A | 9/1956 | Cohee | |
| 3,061,134 | A * | 10/1962 | Fesmire et al. | 220/1.5 |
| 3,092,282 | A * | 6/1963 | Tantlinger et al. | 220/1.5 |
| 3,749,273 | A * | 7/1973 | Wreghitt et al. | 220/1.5 |
| 4,108,326 | A * | 8/1978 | Bertolini | 220/1.5 |
| 4,714,169 | A | 12/1987 | Keenan et al. | |
| 5,449,081 | A | 9/1995 | Sjostedt et al. | |
| 6,422,405 | B1 | 7/2002 | Haenszel | |
| 6,631,821 | B2 | 10/2003 | Vourganas | |
| 6,752,285 | B1 | 6/2004 | Scalf | |
| 6,983,704 | B1 | 1/2006 | Ness | |
| 2003/0150769 | A1 | 8/2003 | Lau | |
| 2005/0058532 | A1 | 3/2005 | Mashburn | |
| 2006/0032850 | A1 | 2/2006 | Theriot et al. | |

* cited by examiner

*Primary Examiner*—Anthony Stashick
*Assistant Examiner*—Harry A Grosso
(74) *Attorney, Agent, or Firm*—Joseph T Regard, Ltd plc

(57) ABSTRACT

A cargo bin formed of a medial cargo module having opposing open ends formed to securely engage an extension member to extend the length of the bin, or an end wall, for use when a non-extended bin is required. A unique engagement mechanism is provided for securely affixing the extension member or end wall to the medial cargo module, wherein there is provided a cradle formed to receive an engagement rod, the engagement mechanism formed to securely guide the components together so as to align engagement apertures associated with the side edges of the units, which engagement apertures, when aligned, are secured via retention pins or the like.

10 Claims, 4 Drawing Sheets

EXTENDABLE CARGO SYSTEM AND METHOD THEREFORE

TECHNICAL FIELD OF THE INVENTION

The present invention relates to cargo bins, baskets, tool carriers or the like, and particularly a medial cargo module having opposing open ends formed to securely engage extension members to selectively extend the length of the bin, or alternatively, an end wall, for use when a non-extended bin is required. A unique engagement mechanism is provided for securely affixing the extension member or end wall to the medial cargo module, wherein on one side there is provided a cradle formed to receive an engagement rod on the other side, the engagement of the rod and cradle such that the components are placed in relative alignment so as to facilitate joining of the pieces and align respective engagement apertures, which are secured via retention pins or the like.

BACKGROUND OF THE INVENTION

Cargo bins, tool baskets or the like are commonly used in servicing the oil industry to convey materials, tools, and supplies to rigs or the like. Crew boats and drilling rigs have very limited space, so it is important that the cargo bin take only as much space as is required to securely and safely convey the contents. As there are a varied array of possible configurations for the items being transported, it is also advantageous to be able to modify a cargo bin to accommodate the various cargo, so as to maximize flexibility of use.

In the past, cargo bins or the like have been designed with knock down walls to make the unit collapsible for enhanced storage. See for example U.S. Pat. No. 6,752,285.

Other cargo bins have been formed so as to be able to be joined into a single, extended unit, such as that shown in the cargo containers of U.S. Pat. No. 3,061,134.

Published patent applications US2005/0058532 and 2006/0032850 teach extendable shipping baskets or the like wherein extended end units engage a central modular unit in socketed fashion, via a pair of upper and lower extension pieces which require relatively precise alignment and simultaneous positioning to engage the unit, which could prove problematic in view of the substantial weight and size of these units.

GENERAL SUMMARY OF INVENTION

The present invention provides an extendable cargo bin system utilizing a new and innovative engagement mechanism to securely affix an extension or end wall to the medial cargo module, which does not require the user to precisely align the entire unit during the engagement process, the engagement mechanism designed to be self aligning.

The engagement mechanism of the present invention comprises a cradle formed at the open end of the unit to be engaged, the cradle having a lip on the end distal the body of the unit to which it is mounted.

Accordingly, one of the units includes the above described cradle, while the unit to be engaged thereto has a bar formed to be placed upon and received by the cradle in such a manner that, upon the units being positioned such that the bar of one unit engaging the cradle on the other unit (in the embodiment shown), the cradle receives the bar to relatively retains the bar in position, facilitating positioning of the units as required to so as to urge the two units into alignment with their ends positioned adjacent to one another. Once in alignment, the two units are locked in place utilizing locking pins or the like.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
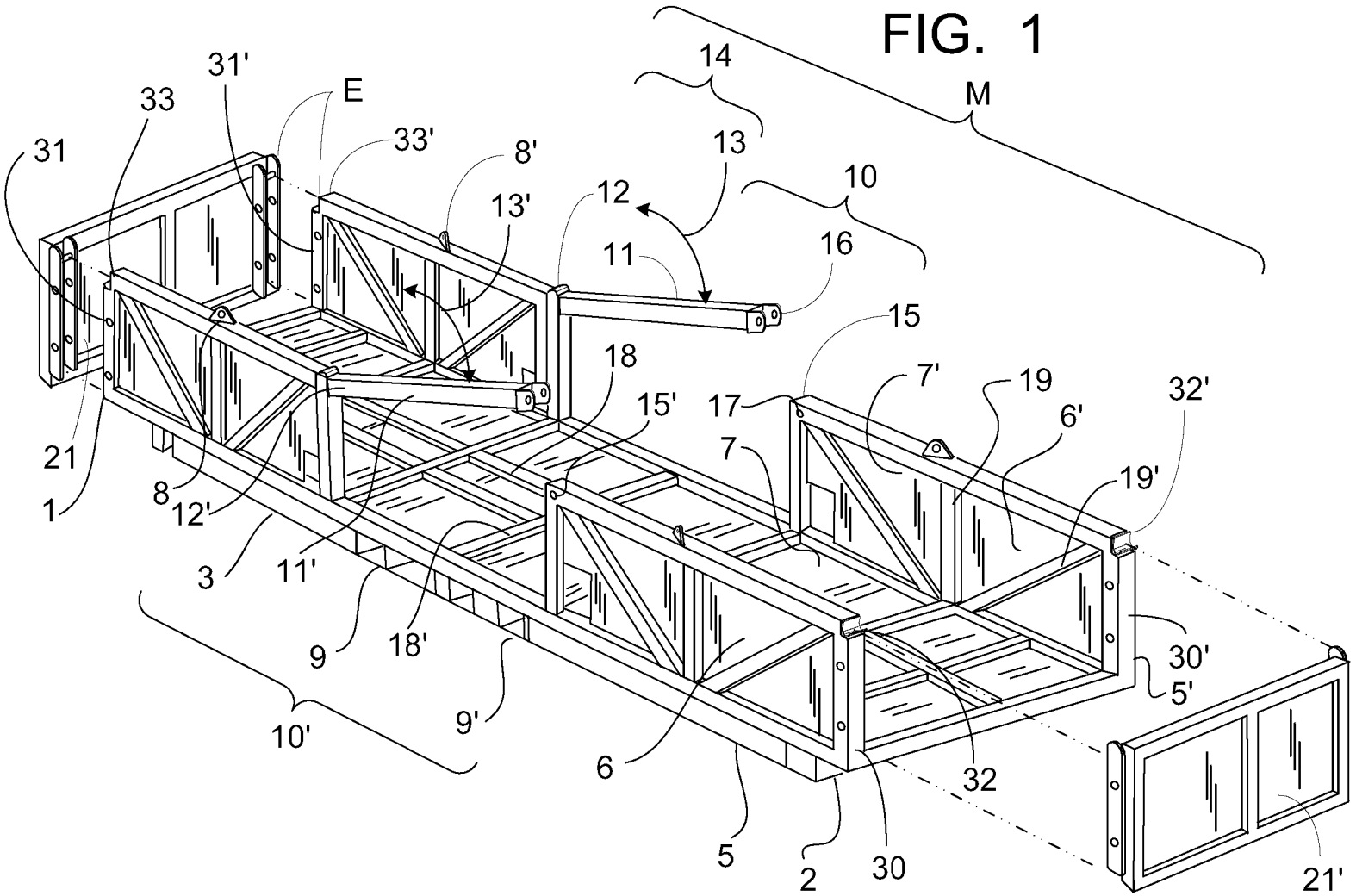
FIG. 1 is a perspective side view of the medial cargo module illustrating the engagement mechanisms associated with the opposing, open ends, and further illustrating the placement and engagement of end walls thereto.
Figure 2:
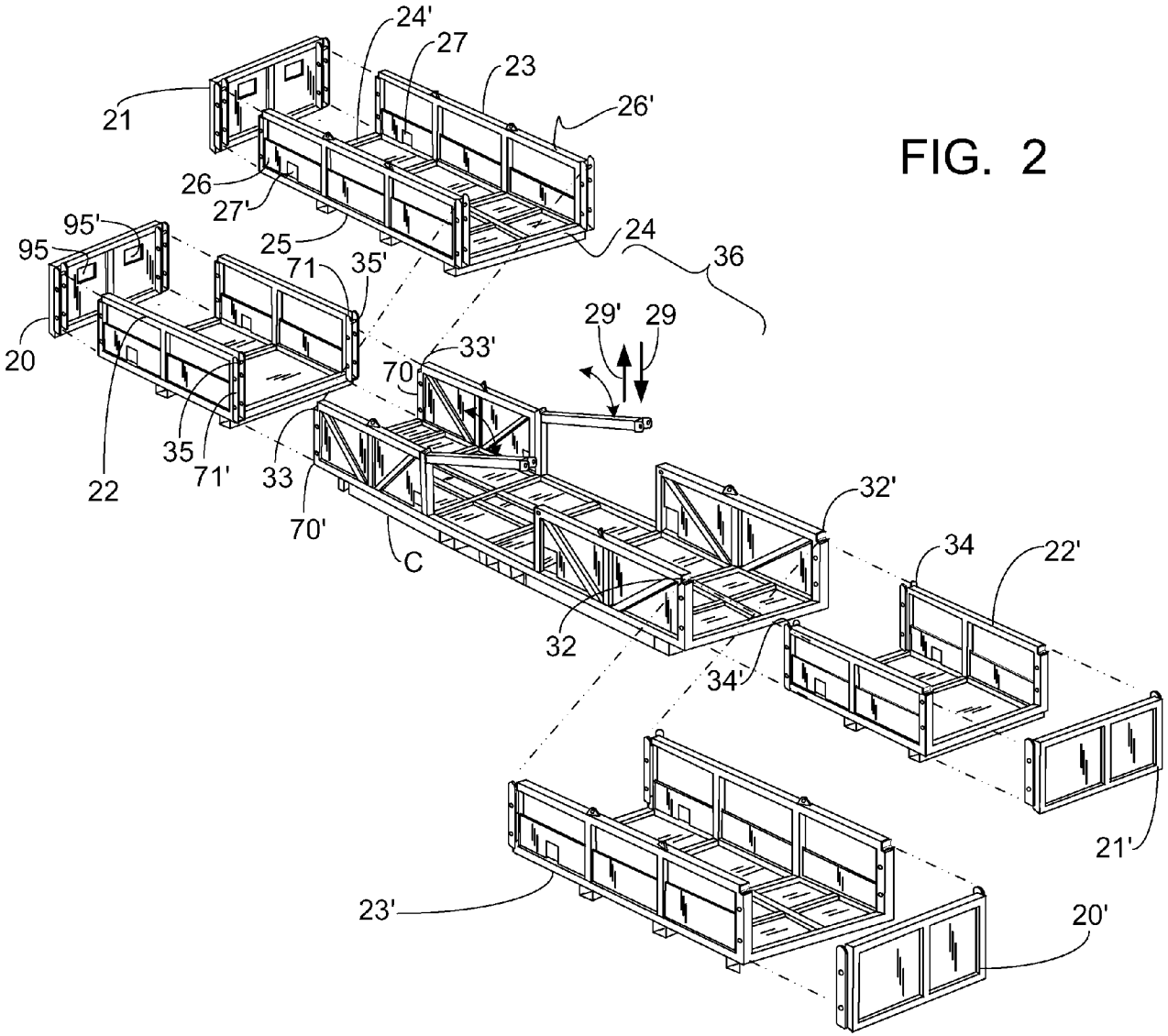
FIG. 2 is a perspective side view of the medial cargo module of FIG. 1 illustrating the placement and engagement of opposing first extensions, or alternatively second longer extensions to the opposing ends of the medial cargo module, as well as the engagement of end walls to the open distal ends of the extension units to form an extended unit.

Referring to FIGS. 1 and 2, a medial cargo module M is formed of a generally rectilinear base 3 of structural steel or the like, the base having first 5 and second 5' side edges and a floor 4 therebetween, and first 6, and second 6' side walls emanating from said first 5 and second 5' side edges, respectively, in parallel fashion to one another while being perpendicular to the floor, forming a containment area.

The floor 4 and side walls 6, 6' in the preferred embodiment are formed of a frame of structural steel having steel panels 7, 7' affixed thereto, respectively, providing an open top structure having first 1 and second 2 open ends, wherein there is provided at the opposing ends of the sidewalls (along vertical end edges 30, 30' and 31, 31') the first component 32, 32' and 33, 33' of a two component engagement mechanism for engaging an extension module, or an end wall having the second component of the engagement mechanism associated therewith, as will be more full described herein.

The base 3 of the unit is shown formed of longitudinally aligned 18 stringers engaging lateral stringers 18' spanning to the side edges, while the side walls are shown formed of a frame of structural steel square tubing reinforced with vertical 19 and diagonally situated 19' stringers.

As shown, the side walls 6, 6' may have formed thereon pad eyes 8, 8' for lifting of the module M via hoist or the like. The base may have situated thereunder slots 9, 9' for receiving forklift tongs or the like for lifting the module, as required. Additionally, securing slots 28, 28' may be formed in the sidewalls for the passage of straps, chains or the like therethrough for securing cargo as required.

The medial cargo module M may have formed therethrough a generally centralized opening 10, 10' in each of the sidewalls 6, 6' to accommodate loading 29 or unloading 29' of the system via forklift or the like, the openings 10, 10' having a width 36 adequate to receive the forklift components during the process. This feature is particularly useful for loading pipe, drilling tools or the like.

First and second bars 11, 11', each having one end 12, 12' pivotally engaged 13, 13' to their respective sidewall may be provided to raise to open, or lower to close the respective openings 10, 10' as required, the bars 11, 11' having a length 14 sufficient to span their respective opening and the free end joinable to the opposing sidewall 15, 15' via locking pins passing through locking apertures 16, 17, respectively.

Continuing with FIGS. 1, 2, 3 and 4, the medial cargo module may be used as a stand-alone cargo bin or the like by affixing first 21 and second 21' end walls to the first 1 and second 2 open ends, respectively, providing a bin or cargo basket for receiving goods for transport. Alternatively, to extend the medial cargo module to accommodate more or longer cargo, one or more short 22, 22' or long 23, 23' extension modules can be affixed to the first and/or second open ends of the medial cargo module.

Like the medial cargo module, the extension modules 22, 22', 23, 23' each have first 24 and second 24' open ends, a rectilinear base 25 having sidewalls 26, 26' emanating therefrom, the base formed of a structural steel frame having steel paneling mounted thereon, and slots 27, 27' formed through the sidewalls for the passage of securing straps therethrough to secure cargo thereon.

As shown in FIG. 2, the first 21 and second 21' end walls may each include side by side slots 95, 95', each for the passage of forklift tongs therethrough, to facilitate positioning of the end walls during the installation and de-installation process.

Continuing with FIGS. 1-4, as indicated previously, at the opposing ends 1, 2 of the medial cargo module M there is provided a first engagement mechanism 32, 32' and 33, 33' (along opposing vertical end edges 30, 30' and 31, 31' of the sidewalls) for engaging an extension module or end wall to the medial cargo module.

A second engagement mechanism 34, 34' and 35, 35' associated with the first end 24 of the extension member to be joined to the medial containment member, is configured to engage a first engagement mechanism situated opposing ends of the extension modules (shown as short 22, 22' and long, 23, 23' extension modules) along the vertical end edges of the sidewalls of the unit.

The engagement means E in the present invention comprises first 33 and 35 second engagement mechanisms formed to engage one another. While the first engagement mechanism 32, 32' and 33, 33' is shown associated with the medial cargo module and the second engagement mechanism is shown associated with the extension modules, it is noted that this description is not intended as being limiting, and that the arrangement may be visa-versa, for example, a pair of second engagement mechanisms may be associated with the medial cargo module, and a pair of first engagement mechanisms may be associated with the extended modules, to join the two to form an extended unit.

Figure 4:
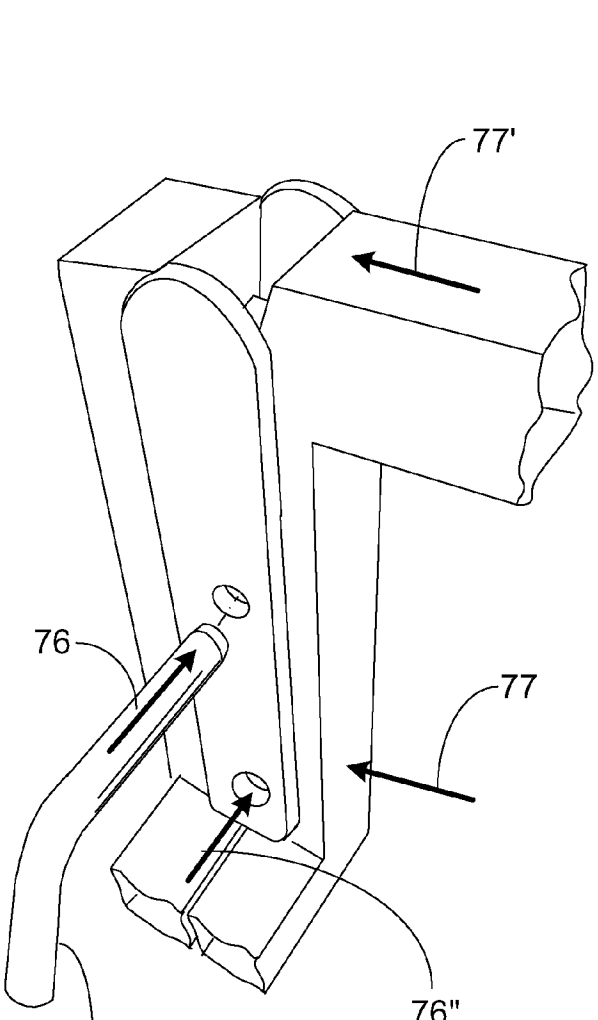
FIG. 4 is a close-up, cut-away, side perspective view of the invention of FIG. 3, illustrating the engagement of the units, as well as the placement of a locking pin into a locking aperture.
Figure 3:
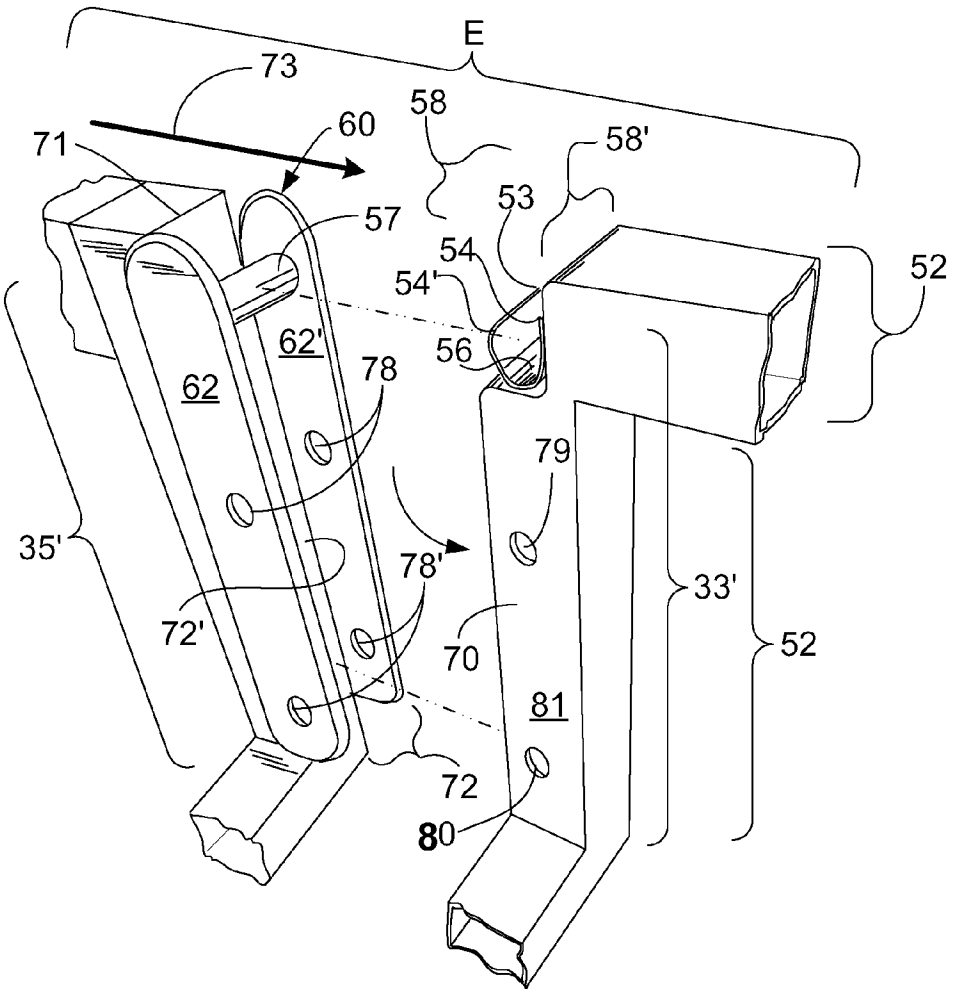
FIG. 3 is a close-up, cut-away, side perspective view of the invention of FIGS. 1 and 2, illustrating the cradle and bar engagement and alignment properties of the engagement mechanism of the present invention, with the saddle and bar shown separate prior to engagement.

Referring to FIGS. 2, 3 and 4, the first engagement mechanism (shown as 33') comprises upper 52 and lower 52' components associated with the ends 70, 70' of the open sidewall forming the one end of the module, each sidewall end comprising a vertical edge having a width 58, the upper component comprising a cradle 53 forming an inner wall 54 and a raised outer wall 54' having a width 58' with an engagement area 56 therebetween, forming a saddle, with the lower component 52' comprising a vertically oriented body 81 of generally uniform width.

The second engagement mechanism (shown as 35') comprises a receiver 60 situated in general alignment with the ends 71, 71' of the sidewall on the module to be joined, the receiver formed of first 62 and second 62' aligned plate members forming a space 72' therebetween, the receiver having a width 72 and depth to envelope the cradle 53 and end 70 of the sidewall of the module to be joined.

Figure 6:
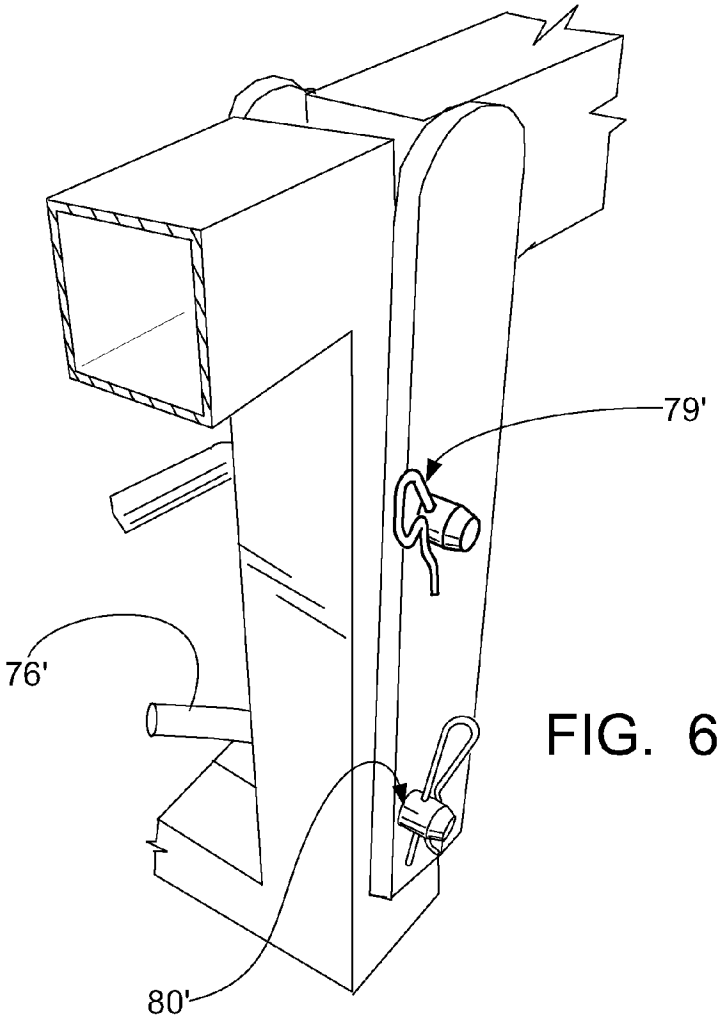
FIG. 6 is a close-up, cut-away, side perspective view of the rear of cradle and bar engagement and alignment of the locking apertures.
Figure 5:
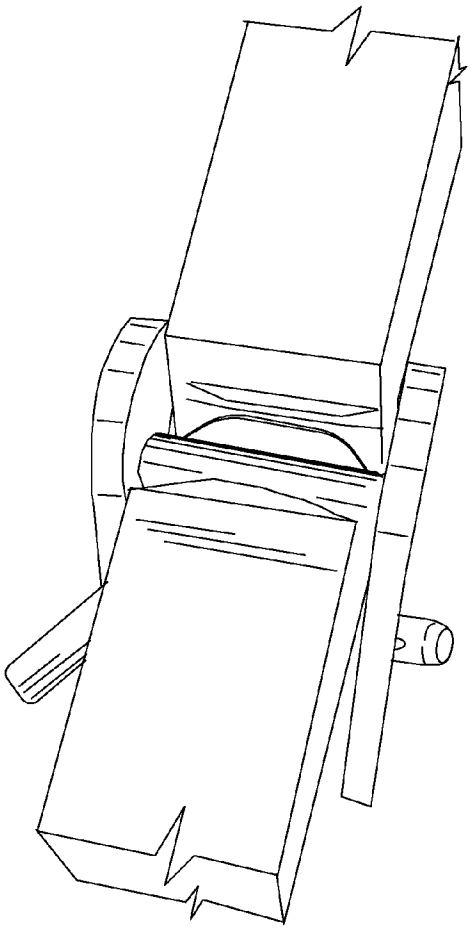
FIG. 5 is a close-up, cut-away, top perspective view of the invention of FIG. 4, illustrating the cradle and bar engagement and alignment of the locking apertures.

Situated in transverse manner relative to and between first 62 and second 62' plate members forming the receiver 6, in the upper portion of the receiver, is a mounting bar 57 configured to engage 73 the cradle 53, such that the mounting bar 57 rests upon the cradle. With the mounting bar 57 engaging or resting upon the cradle 53, the receiver 60 of the second engagement mechanism is urged to pivot 74 or otherwise position 77, 77' to envelope the body 81 formed at the end 70 of the first engagement mechanism, at which point pins 76, 76' are urged 76" through aligned apertures 79, 79', 80, 80' to lock the first and second engagement mechanisms to one another, effectively joining the two components as shown in FIGS. 4-6.

While FIGS. 3-6 illustrate a cutaway view of the joining of a single set of first 33' and second 35' engagement mechanisms, it should be understood that in joining an extension or end wall to the open end of a medial cargo module, first and second, first engagement mechanisms 32, 32' or 33, 33' would more or less simultaneously engage first and second, second engagement mechanisms 34, 34' or 35, 35' in the manner discussed above and illustrated in the figures.

Similarly, to the discussion with end wall 20 used to enclose the medial cargo module above, said end wall 20 may also be used to enclose an open end of an extension module 22 or 23, as required, utilizing the same engagement mechanism situated at opposing ends of the sidewalls of the units. Of course, two end walls 20, 20' may be used to enclose both open ends as required.

In use, the medial cargo module may have affixed to first and second extension modules (of the short or long type as referenced above) at each open end of the medical cargo module, with end walls enclosing the free open ends of the attached extension modules. Also, the medial cargo module may utilize only a single extension on one open end, with end walls utilized at the remaining open end of the medial cargo module and attached extension module.

In summary, the present system provides a flexible means of providing a unit for conveying cargo, whether as a cargo bin, cargo basket, tool basket, or the like, of various length configurations, through the ability to combine extensions of varying lengths and end walls to a medial cargo module.

A method of use of the present invention can be summarized in the steps of:

a. providing a first cargo module comprising:

a generally rectilinear base having first and second side edges;

first and second sidewalls affixed to said first and second side edges, respectively, said first and second sidewalls each having a first end, forming a first open end;

first engagement mechanisms associated with said first end of each of said first and second sidewalls of said first cargo module, said first engagement mechanisms each comprising a cradle and a body having a width;

b. providing a second cargo module, comprising:

a generally rectilinear base having first and second side edges;

first and second sidewalls affixed to said first and second side edges, respectively, said first and second sidewalls each having a first end, forming a first open end;

second engagement mechanisms associated with said first end of each of said first and second sidewalls of said second cargo module, said second engagement mechanisms each comprising first and second parallel plate members having a uniform space therebetween to form a receiver, and a mounting bar situated in transverse fashion relative to and between said first and second parallel plate members;

c. positioning said mounting bars associated with each of said first and second sidewalls of said second cargo module in contact with said respective cradles of said first and second sidewalls of said first cargo module, providing an engagement between said mounting bars and said cradles;

d. utilizing said engagement of each said mounting bar and cradle to align each said receiver to position each said receiver to envelope each said corresponding body of said each first engagement member;

e. aligning and retaining each of said first and second sidewalls of said first cargo module to each of said respective first and second sidewalls of said second cargo module;

f. engaging said first open end of said first cargo module to said first open end of said second cargo module;

g. locking each said receiver about said corresponding body of each said first engagement member, locking said first cargo module to said second cargo module, providing an extended cargo module.

The method of enclosing an open end of a cargo module of the present invention can be summarized as comprising the steps of:

a. providing a cargo module comprising:

a generally rectilinear base having first and second side edges;

first and second sidewalls affixed to said first and second side edges, respectively, said first and second sidewalls each having a first end, forming a first open end;

first engagement mechanisms associated with said first end of each of said first and second sidewalls of said first cargo module, said first engagement mechanisms each comprising a cradle and a body having a width;

b. providing an endwall comprising, comprising:

a generally rectilinear structure having first and second side edges;

second engagement mechanisms associated with said first and second side edges of said endwall, said second engagement mechanisms each comprising first and second parallel plate members having a uniform space therebetween to form a receiver, and a mounting bar situated in transverse fashion relative to and between said first and second parallel plate members;

c. positioning said mounting bars in contact with said respective cradles of said first and second sidewalls of said first cargo module, providing an engagement between said mounting bars and said cradles;

d. utilizing said engagement of each said mounting bar and cradle to align each said receiver to position each said receiver to envelope each said corresponding body of said each first engagement member;

e. aligning and retaining each of said first and second sidewalls of said first cargo module to said endwall;

f. engaging said first open end of said first cargo module to said endwall;

g. locking each said receivers about said corresponding body of each said first engagement member, locking said endwall to said first cargo module.

| Element | Description |
|---|---|
| C | Medial cargo module |
| 1 | first open end |
| 2 | second open end |
| 3 | rectilinear base |
| 4 | floor |
| 5,' | first, second side edges |
| 6,' | sidewalls |
| 7, 7' | steel panels floor 7, walls 7' |
| 8, 8' | padeyes |
| 9, 9' | slots (lifting) |
| 10,' | centralized opening |
| 11, 11' | first and second bars |
| 12,' | ends |
| 13,' | pivotally engaged |
| 14 | length |
| 15,' | opposing sidewall |
| 16 | locking aperture |
| 17 | locking aperture |
| 18,' | longitudinally aligned stringers, lateral— |
| 19,' | vertical, diagonal stringers— |
| 20,' | end walls |
| 21 | first, second endwalls— |
| 22, 22' | short extension module |
| 23,' | long extension modules |
| 24, ' | open ends |
| 25 | rectilinear base |
| 26,' | sidewalls |
| 27,' | slots for straps formed through sidewalls |
| 28,' | slots in medial cargo module |
| 29,' | loading, unloading |
| 30,' | first pair sidewall vertical edges at end |
| 31,' | second pair of sidewall vertical edges at end |
| 32, ' | first engagement mechanism |
| 33, ' | first engagement mechanism |
| 34,' | second engagement mechanism |
| 35,' | second engagement mechanism |
| 36 | width of opening |
| 52 | lower, upper components |
| 53 | cradle |
| 54,' | inner outer wall |
| 55 | lip |
| 56 | engagement area |
| 57,' | mounting bar |
| 58,' | width of bar, cradle |
| 59 | mounted |
| 60 | receiver |
| 61 | width receiver, opposing wall |
| 62 | first, second aligned members |
| 63 | aligned mounting apertures |
| 64 | " |
| 65 | aligned |
| 66 | locking pins |
| 67 | pivot |
| 68 | end panels |
| 69 | longitudinal axis |
| 70,' | ends |
| 71 | laterally mounted |
| 72 | space |
| 73 | slip |
| 74 | pivot |
| 75 | locking pins |
| 76 | pass |
| 77 | positioned |
| 78,' | apertures |
| 79,' | apertures |
| 80,' | apertures |
| 81 | body |

EXEMPLARY SPECIFICATION

Medial Cargo Module Dimensions:

Short Extension Module Dimensions:

Long Extension Module:

Capacity of Medial Cargo Module with Short Extension Modules mounted to both ends:

Capacity of Medial Cargo Module with Long Extension Modules mounted to both ends:

Capacity of Medial Cargo module with no extensions (end walls mounted to opposing ends):

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. An extendable cargo apparatus, comprising:

a first cargo module comprising:

first and second sidewalls, each said sidewall having an end having a first engagement mechanism mounted thereto, each of said first engagement mechanisms comprising a cradle and an adjacent body having a width;

a second cargo module, comprising:

first and second sidewalls, each said sidewall having an end having a second engagement mechanism mounted thereto, each of said second engagement mechanisms comprising first and second parallel plate members having a uniform space therebetween to form a receiver, and a mounting bar situated transverse to and between said first and second parallel plate members;

whereby, upon positioning said mounting bars associated with each of said first and second sidewalls of said second cargo module to engage said respective cradles associated with said first and second sidewalls of said first cargo module, said receivers are positioned to envelope said corresponding body of said first engagement member, so as to align and retain said first and second sidewalls of said first cargo module to said first and second sidewalls of said second cargo module, so as to provide an extended cargo module.

2. The apparatus of claim 1, wherein said body of said first engagement mechanism has an aperture formed therethrough, wherein said first and second plates forming said receiver of said second engagement mechanism has an aperture formed therethrough, and wherein, upon positioning of said mounting bar of said second engagement member in contact with said cradle of said first engagement mechanisms, said receiver is positioned to envelope said corresponding body of said engagement member such that said aperture of said first engagement mechanism is aligned with said aperture of said second engagement mechanism.

3. The apparatus of claim 2, wherein there is further provided a locking pin formed to be placed into said aperture of said first and second engagement mechanisms, so as to retain said receiver about said body.

4. The apparatus of claim 3, wherein said mounting bar engages said cradle in pivotal fashion, so as to facilitate pivotal engagement of said first cargo module and said second cargo module to facilitate alignment of said receiver of said second engagement mechanism about said body of said first engagement mechanism.

5. The apparatus of claim 4, wherein said first cargo module has a second end having associated therewith an engagement mechanism comprising a cradle and a body having a width, said apparatus further comprising:

a third cargo module, comprising first and second sidewalls, each said sidewall having an end having a second engagement mechanism mounted thereto, each of said second engagement mechanisms comprising first and second parallel plate members having a uniform space therebetween to form a receiver, and a mounting bar situated transverse to and between said first and second parallel plate members whereby, upon positioning said mounting bars associated with each of said first and second sidewalls of said third cargo module to engage said respective cradles associated with said second end of said first cargo module, said receivers are positioned to envelope said corresponding body of said first engagement member, so as to align and retain said first and second sidewalls of said first cargo module to said first and second sidewalls of said third cargo module, so as to provide an extended cargo module comprising said first, second and third cargo modules.

6. The apparatus of claim 5, wherein said body of said engagement mechanism of said open end of said first cargo module has an aperture formed therethrough, wherein said first and second plates forming said receiver of said second engagement mechanism of said cargo module has an aperture formed therethrough, and wherein, upon positioning of said mounting bar of said second engagement member in contact with said cradle of said engagement mechanism of said open end of said first cargo module, said receiver is positioned to envelope said corresponding body of said engagement member such that said aperture of said body of said open end of said first cargo module is aligned with said aperture of said receiver of said second engagement mechanism so as to provide aligned apertures.

7. The apparatus of claim 6, wherein there is further provided a locking pin formed to be placed into said aligned apertures, so as to retain said receiver of said third cargo module about said body at said open end of said first cargo module.

8. The apparatus of claim 7, wherein said mounting bar of said third cargo module engages said cradle of said open end of said first cargo module in pivotal fashion, so as to facilitate alignment of said receiver of said third cargo module about said body of said open end of said first engagement mechanism.

9. The method of providing an extendable cargo apparatus, comprising the steps of:

a. providing a first cargo module comprising:

a generally rectilinear base having first and second side edges;

first and second sidewalls affixed to said first and second side edges, respectively, said first and second sidewalls each having a first end, forming a first open end;

first engagement mechanisms associated with said first end of each of said first and second sidewalls of said first cargo module, said first engagement mechanisms each comprising a cradle and a body having a width;

b. providing a second cargo module, comprising:

a generally rectilinear base having first and second side edges;

first and second sidewalls affixed to said first and second side edges, respectively, said first and second sidewalls each having a first end, forming a first open end;

second engagement mechanisms associated with said first end of each of said first and second sidewalls of said second cargo module, said second engagement mechanisms each comprising first and second parallel plate members having a uniform space therebetween to form a receiver, and a mounting bar situated in transverse fashion relative to and between said first and second parallel plate members;

c. positioning said mounting bars associated with each of said first and second sidewalls of said second cargo module in contact with said respective cradles of said first and second sidewalls of said first cargo module, providing an engagement between said mounting bars and said cradles;

d. utilizing said engagement of each said mounting bar and cradle to align each said receiver to position each said receiver to envelope each said corresponding body of said each first engagement member;

e. aligning and retaining each of said first and second sidewalls of said first cargo module to each of said respective first and second sidewalls of said second cargo module;

f. engaging said first open end of said first cargo module to said first open end of said second cargo module;

g. locking each said receiver about said corresponding body of each said first engagement member, locking said first cargo module to said second cargo module, providing an extended cargo module.

10. The method of providing an of enclosing an cargo apparatus having an open end, comprising the steps of:

a. providing a cargo module comprising:

a generally rectilinear base having first and second side edges;

first and second sidewalls affixed to said first and second side edges, respectively, said first and second sidewalls each having a first end, forming a first open end;

first engagement mechanisms associated with said first end of each of said first and second sidewalls of said first cargo module, said first engagement mechanisms each comprising a cradle and a body having a width;

b. providing an endwall comprising, comprising:

a generally rectilinear structure having first and second side edges;

second engagement mechanisms associated with said first and second side edges of said endwall, said second engagement mechanisms each comprising first and second parallel plate members having a uniform space therebetween to form a receiver, and a mounting bar situated in transverse fashion relative to and between said first and second parallel plate members;

c. positioning said mounting bars in contact with said respective cradles of said first and second sidewalls of said first cargo module, providing an engagement between said mounting bars and said cradles;

d. utilizing said engagement of each said mounting bar and cradle to align each said receiver to position each said receiver to envelope each said corresponding body of said each first engagement member;

e. aligning and retaining each of said first and second sidewalls of said first cargo module to said endwall;

f. engaging said first open end of said first cargo module to said endwall;

g. locking each said receivers about said corresponding body of each said first engagement member, locking said endwall to said first cargo module.

* * * * *